US006443599B1

(12) United States Patent
Wu

(10) Patent No.: US 6,443,599 B1
(45) Date of Patent: Sep. 3, 2002

(54) LAMP COVER STRUCTURE FOR EASY ASSEMBLY

(76) Inventor: Wen-Chang Wu, No. 10, Lane 191, Hsi Hsin Street, Chuang Ya Tsun, Hsiu Shui Hsiang, Chang Hua Hsien (TW)

( * ) Notice: Subject to any disclaimer, the term of this patent is extended or adjusted under 35 U.S.C. 154(b) by 0 days.

(21) Appl. No.: 09/764,265

(22) Filed: Jan. 19, 2001

(51) Int. Cl.[7] ..... F21V 1/06
(52) U.S. Cl. ..... 362/352; 362/351; 362/358
(58) Field of Search ..... 362/352, 356, 362/358, 434, 450, 351

(56) References Cited

U.S. PATENT DOCUMENTS 4,290,099 A * 9/1981 Vicars-Harris ..... 362/352
5,375,048 A * 12/1994 Barnes ..... 362/352
6,315,434 B1 * 11/2001 Long ..... 362/352

* cited by examiner

*Primary Examiner*—Thomas M. Sember
(74) *Attorney, Agent, or Firm*—Troxell Law Office PLLC

(57) ABSTRACT

A lamp cover structure for easy assembly having a top ring with radial support bars, a bottom ring, of which the perimeter is greater than that of the top ring, and a support frame connecting the top ring and the bottom ring. Ends of the support bars are folded inward to form clip hooks. Upper transversal arch bars of the support frame have concave clip grooves bent downward to engage the clip hooks. The bottom ring has inwardly inclined support bars engaged by the support frame to constrain movement of the support frame.

6 Claims, 6 Drawing Sheets

LAMP COVER STRUCTURE FOR EASY ASSEMBLY

BACKGROUND OF THE INVENTION

1) Field of the Invention

The invention is related to a lamp cover structure for easy assembly, of which the support bars extend radially from the top ring. The end of the bars are folded upward to fix on the clip hooks of the ring rim, thus the clip grooves on the upper transversal arch bars of the support frame hit exactly the clip hooks. On the support locations of the support frame, support bars are accordingly extruded on the bottom ring, thus the lower transversal arch bars on the support frame hit exactly the upper part of the bottom ring. Through the fixture of support bars, the support frame connects the support bars and the bottom to constrain the movement of the support frame. For assembly, one may lay the support frame horizontally. The lamp cover can thus be assembled with minimum volume to achieve easy assembly and to reduce storage volume and delivery cost.

2) Description of the Prior Art

Please refer FIG. 6, the traditional lamp cover 5. Most of the support frames directly connect the top ring and the bottom ring to form the lamp cover structure. There are many practical defects for this kind of lamp cover structure.

The prior lamp covers form certain structural shapes, therefore, the covers can not be compressed during delivery and the products take too much space. The storage and delivery volume for this kind of product can not be reduced, hence the delivery cost is raised. It leads to cost increase.

Due to the above defects, the products lead to current disadvantage in usage. On the basis of thorough research for constant improvement, the inventor finally developed the invention, a kind of lamp cover for easy assembly and great improvement in practical usage.

SUMMARY OF THE INVENTION

The primary objective of the invention is to provide a lamp cover structure for easy assembly. It mainly comprises of a top ring, a bottom ring, and a support frame, which exactly connects the top ring and the bottom ring. The top ring extends radially with support bars. The ends of support bars are folded clip hooks, which are bent upward to form clip hooks for the fixture of the ring rim. On the location of the upper transversal arch bar on the support frame near the clip hooks, concave clip grooves are bent downward to hit exactly the clip hooks. Upon the location of a support frame, the bottom ring extrudes the support bars accordingly, thus the lower transversal arch bars on the support frame hit exactly the top of a bottom ring. Through the fixture of support bars, the support frame connects the support bars and the bottom to constrain the movement of the support frame. For the assembly, one may lay the support frame horizontally. Therefore, the lamp cover can be assembled with minimum volume to achieve easy assembly and to reduce storage volume and delivery cost.

The additional objective of the invention is to provide a lamp cover structure for easy assembly. The support frame comprises of dual vertical arch bars and upper arch bars. The bottom of the support frame forms insert tenons, which are perpendicular to the bottom ring and insert the ring bases of the bottom ring. On the support portion of the support frame on the bottom ring, there are accordingly inward ring bases, which are hollow ring structure. The insert tenons exactly insert into the positioning ring bases. After the insert of the tenons on the support frame into the ring bases, the upper transversal arch bars hit exactly the clip hooks on the end of support bars for the movement constraint of the support frame. Therefore, the lamp cover can be assembled with minimum volume to achieve easy assembly and to reduce storage volume and delivery cost.

The followings are brief description and legend for optimal embodiments of the invention for committee3 s better understanding in the structural characteristics and operations of the invention.

DETAILED DESCRIPTION OF THE PREFERRED EMBODIMENT

Figure 1:
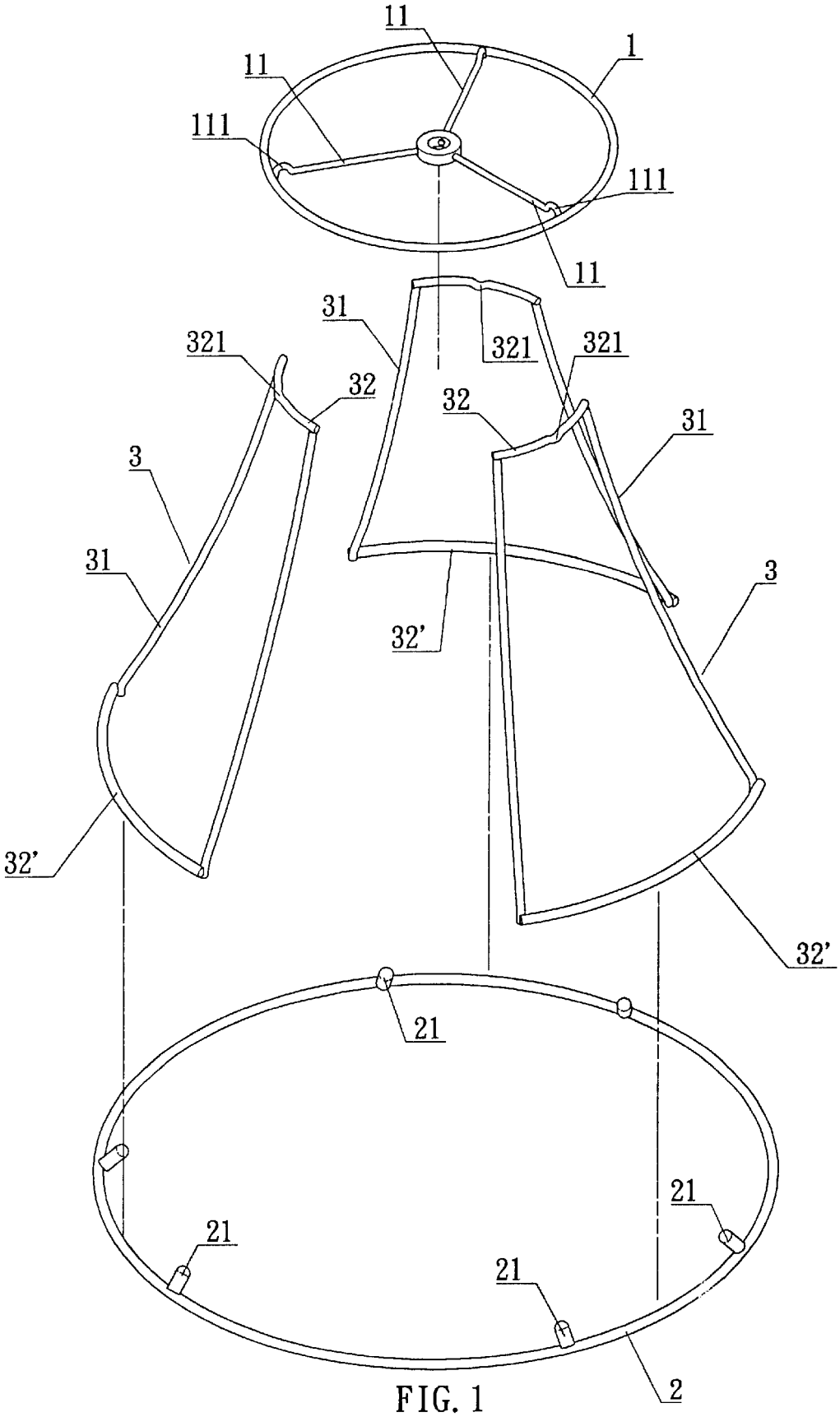
FIG. 1 is an exploded drawing of the invention.
Figures 2, 2A, 2B:
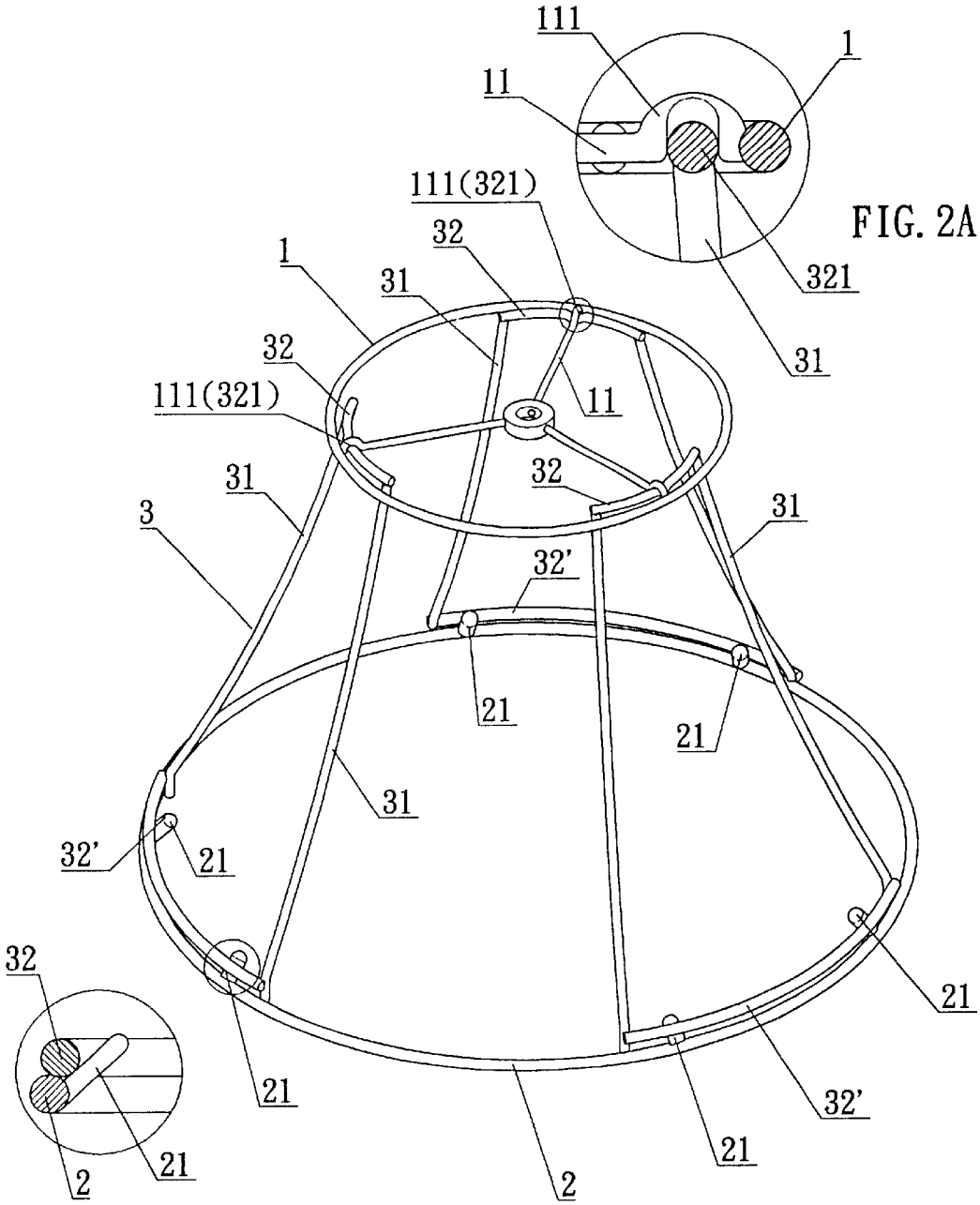
FIG. 2 is an isometric assembly drawing of the invention.
FIG. 2A is an enlarged planar drawing of the top ring and the support portion on the support frame.
FIG. 2B is an enlarged elevation drawing of the top ring and the support portion on the support frame.

Please refer FIG. 1 for the comprehension of the structure for the invention. It comprises a top ring 1 on the very top of the lamp cover, a bottom ring 2, of which the perimeter is greater than that of the top ring, and a support frame 3 for the connection of the top ring and the bottom ring.

The top ring 1 made of metal is a round-cylinder structure and exactly hits the stand bar of a table lamp. The top ring has radial support bars 11. The end of the bar is a folded clip hook 111, which is fixed on the rim of the top ring for the connection and interlock of the support frame 3.

The bottom ring 2 is located on the support portion of a support frame 3 and has inwardly inclined support bars 21. Thus, a clip space is formed between the support bars 21 and the bottom ring 2. The lower transversal arch bar 32' on the support frame 3 aligns exactly with the clip space above the bottom ring 2. Through the clipping of the support bars 21, the support frame 3 connects the support bars 21 and the bottom ring for the movement constraint of the support frame 3.

The support frame 3 comprises dual vertical arch bars 31 connected to upper and lower transversal arch bars 32, 32'. The upper transversal arch bars 32 match the curvature of the top ring and the lower transversal arch bars 32' match the curvature of the bottom ring. On the location of the upper transversal arch bar 32 of the support frame near the support bar 11, the concave clip grooves 321 engage the clip hooks 111. The lower transversal arch bars on the support frame engage the bottom ring 2 for the movement constraint of the support frame.

Figure 3:
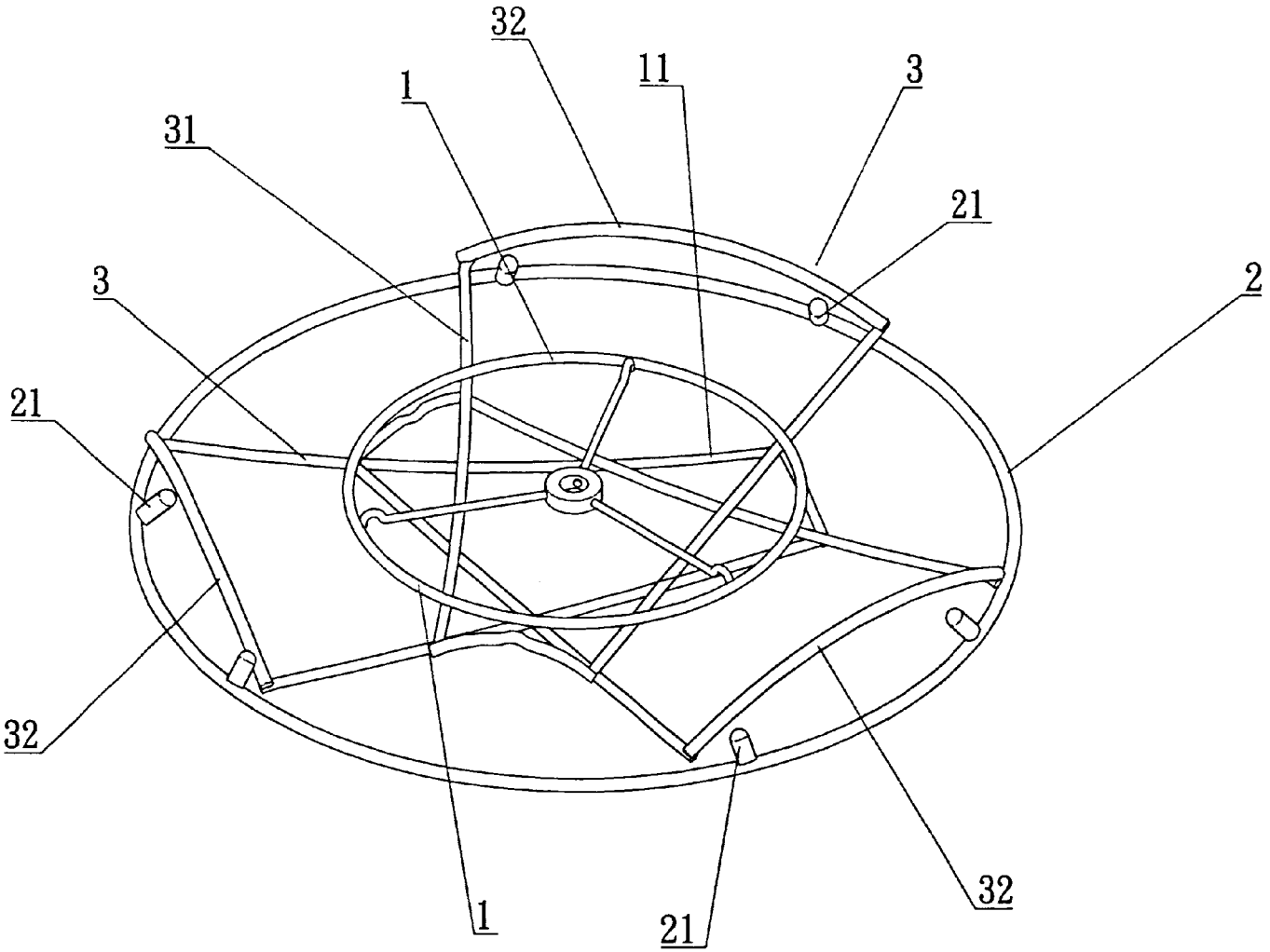
FIG. 3 is the folded and unfolded drawing of an embodiment for the invention.

FIG. 3 illustrates the folded position of the invention. For assembly, the support frame 3 should be removed and laid horizontally. Thus, the lamp cover can be assembled with minimum volume for convenient assembly and volume reduction to achieve the effect of delivery cost decrease.

Figures 4, 4A:
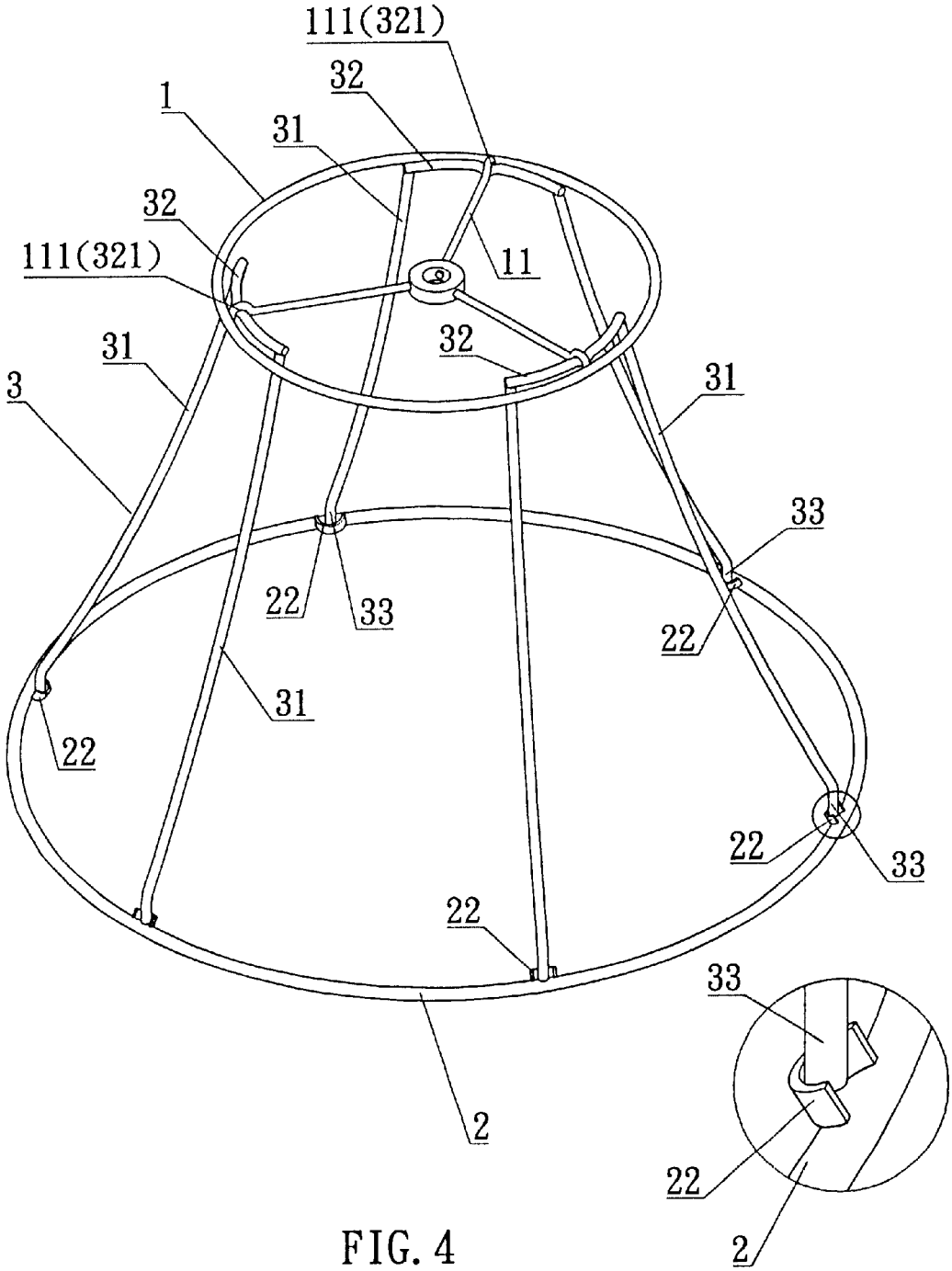
FIG. 4 is another drawing of an embodiment for the invention.
FIG. 4A is an enlarged drawing of the top ring and the connection portion on the support frame.

FIG. 4 shows another embodiment in which the support frame comprises dual vertical arch bars 31 and upper arch bars 32. The bottom of the support frame forms insert tenons 33, which are perpendicular to the bottom ring and insert into the ring bases 22 of the bottom ring. On the bottom ring 2, there are inwardly inclined ring bases 22, which are hollow ring structures. The insert tenons 33 insert into the positioning ring bases 22. After the insert of the tenons 33 on the support frame into the ring bases 22, the upper transversal arch bars 32 are aligned with the clip hooks 111 on the end of support bars for the movement constraint of the support frame 3.

Figures 5, 5A:
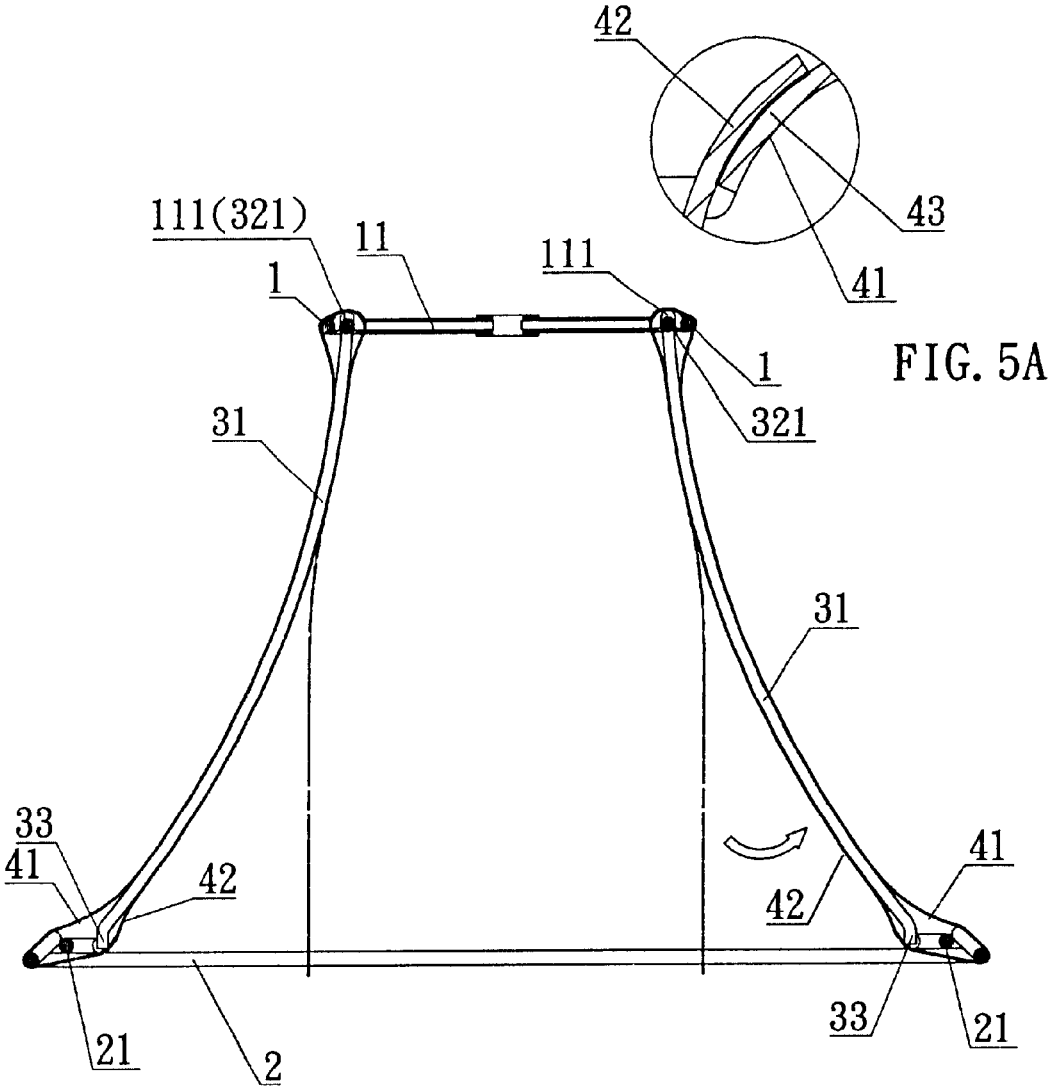
FIG. 5 is an embodiment drawing of a lamp cover for the invention.
FIG. 5A is an enlarged drawing of the adhesion portion.
Figure 6:
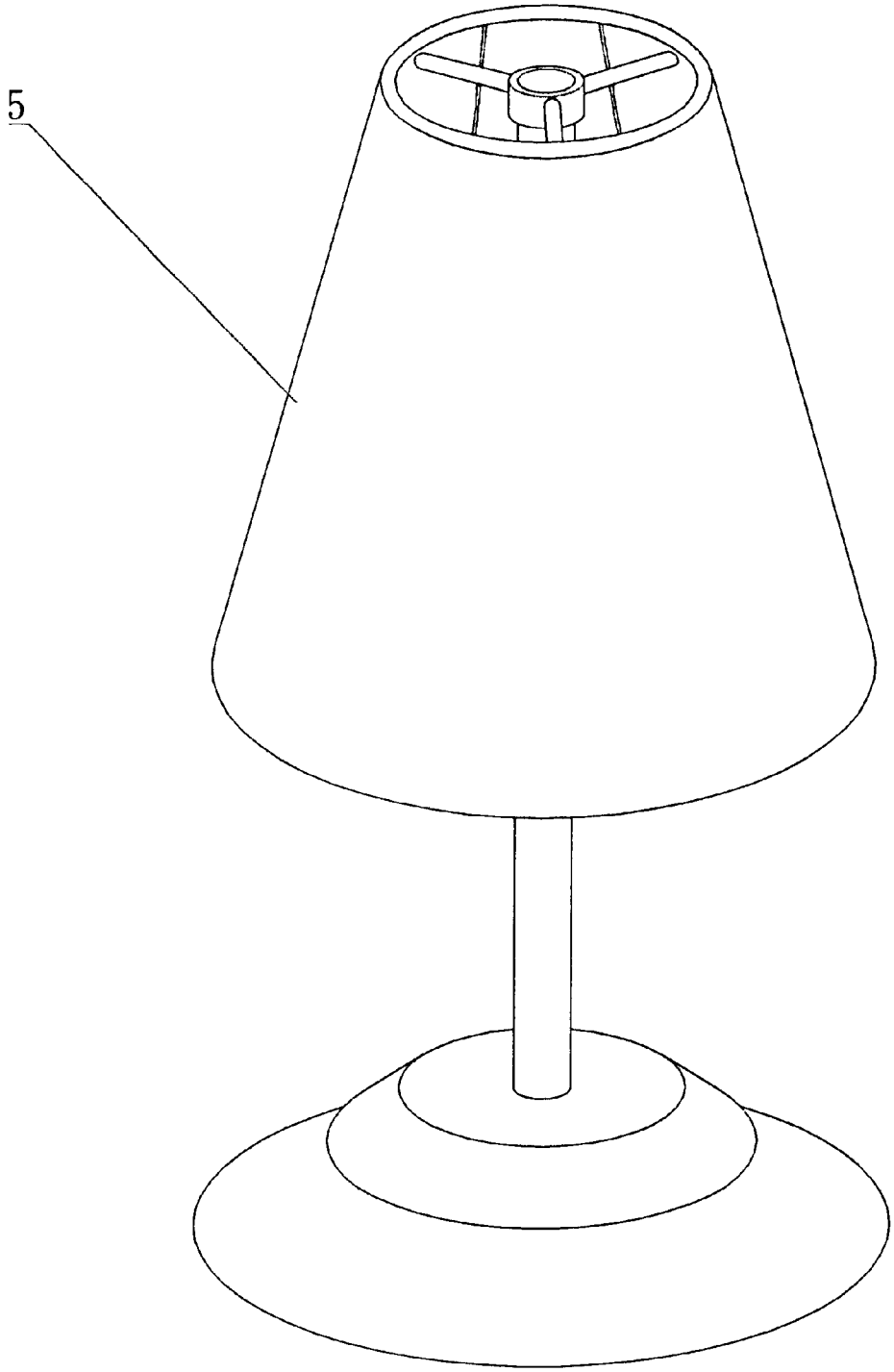
FIG. 6 PRIOR ART
FIG. 6 is an isometric drawing of the prior lamp cover.

Please refer to FIG. 5. After the assembly, a cloth cover can be covered on the exterior area between the top ring and the bottom ring. One may make the exterior cloth 41 tight in advance and fasten it on the rim of the support frame 3, then, lay an inner layer cloth 42 on the interior of the support frame 3. On the appropriate locations, there are adhesion bands 43 on the inner and external cloth to wrap around the support frame. The frame is not exposed and the structure of combined cloth is formed for the effect of esthetics. It can also be folded together with the lamp cover to reduce volume and to decrease delivery cost.

The above explanation is a substantial embodiment of the invention, which provides greater practical performance and simplification than products of prior art.

What is claimed is:

1. A lamp cover structure for easy assembly comprising:

a) a top ring having a plurality of radially extending support bars, outward end portions of the support bars bent upwardly forming clip hooks;

b) a bottom ring having a plurality of inwardly inclined supports forming clip spaces; and, c) a plurality of support frames releasably interconnecting the top and bottom rings, each support frame having two spaced apart vertical arch bars with upper end portions, an upper transverse arch bar connecting the upper end portions of the vertical arch bars, the upper transverse arch bar having a curvature matching a curvature of the top ring and forming a clip groove configured to engage the clip hook of the radially extending support bar, each vertical arch bar having a bottom portion configured to releasably engage the inwardly inclined supports of the bottom ring, whereby engagement of the bottom end portions with the inclined supports and engagement of the clip grooves with the clip hooks forms a lamp cover frame with the top and bottom rings spaced apart.

2. The lamp cover structure of claim 1 wherein the inwardly inclined supports comprise inwardly inclined bottom support bars extending from the bottom ring.

3. The lamp cover structure of claim 2 wherein the support frames each further comprise a lower transverse arch bar interconnecting the bottom portions of the vertical arch bars, the lower transverse arch bar having a curvature matching a curvature of the bottom ring.

4. The lamp cover structure of claim 1 wherein the inwardly inclined supports comprise inwardly inclined hollow ring bases extending from the bottom ring.

5. The lamp cover structure of claim 4 wherein the bottom portions of the vertical arch bars form insert tenons removably engageable with the inwardly inclined hollow ring bases.

6. The lamp cover structure of claim 1 further comprising an exterior cloth and an interior cloth fastened on the top and bottom rings.

* * * * *